US006200391B1

(12) United States Patent
Ohshiro

(10) Patent No.: US 6,200,391 B1
(45) Date of Patent: Mar. 13, 2001

(54) TOBACCO FLAVORING AGENT

(75) Inventor: Michimasa Ohshiro, Kanagawa (JP)

(73) Assignee: Ohshiro Co., Ltd., Kawasaki (JP)

( * ) Notice: Subject to any disclaimer, the term of this patent is extended or adjusted under 35 U.S.C. 154(b) by 0 days.

(21) Appl. No.: 09/147,583

(22) PCT Filed: Sep. 18, 1998

(86) PCT No.: PCT/JP98/04211

§ 371 Date: Jan. 27, 1999

§ 102(e) Date: Jan. 27, 1999

(87) PCT Pub. No.: WO99/15036

PCT Pub. Date: Apr. 1, 1999

(30) Foreign Application Priority Data

Sep. 22, 1997 (JP) ..... 9-256538

(51) Int. Cl.[7] ..... A24B 15/30; A24B 15/42

(52) U.S. Cl. ..... 131/275; 131/274; 131/276; 131/347; 131/352; 131/359

(58) Field of Search ..... 131/274, 275, 131/276, 359, 352, 347

(56) References Cited

U.S. PATENT DOCUMENTS 4,620,554 * 11/1986 Horimoto ..... 131/270

FOREIGN PATENT DOCUMENTS

| | | |
|---|---|---|
| 59-183679 | 10/1984 | (JP) . |
| 61-31074 | 2/1986 | (JP) . |
| 62-14772 | 1/1987 | (JP) . |
| 62-14774 | 1/1987 | (JP) . |
| 63-59871 | 3/1988 | (JP) . |
| 1-68798 | 5/1989 | (JP) . |
| 2-35067 | 2/1990 | (JP) . |
| 2-39876 | 2/1990 | (JP) . |
| 3-61471 | 3/1991 | (JP) . |
| 4-110496 | 9/1992 | (JP) . |
| 5-507618 | 11/1993 | (JP) . |
| 6-50500 | 7/1994 | (JP) . |
| 7-39492 | 7/1995 | (JP) . |
| 8-332068 | 12/1996 | (JP) . |
| 9-238667 | 9/1997 | (JP) . |
| 10066557 * | 3/1998 | (JP) . |

OTHER PUBLICATIONS

Masayoshi NIO, "Tobacco Industry", Nov. 1, 1950, Sangyo Hyoron Co.

Author—Not Found, "Materials for Manufacturing Tobacco", Text Book for Tobacco Manufacturing Technologies vol. 3, Jun. 25, 1962, Japan Tobacco Public Corporation.

* cited by examiner

*Primary Examiner*—James Derrington
(74) *Attorney, Agent, or Firm*—Oblon, Spivak, McClelland, Maier & Neustadt, P.C.

(57) ABSTRACT

In a tobacco flavoring agent containing ascorbic acid, a salt or isomer thereof, a chlorophyll-containing material, and potassium nitrate, the maximum particle size of the potassium nitrate is set to 0.8 mm or less, making it possible to obtain a tobacco flavoring agent that lowers the tar or nicotine content of tobacco smoke, maintains a burning portion of tobacco in a stable state, and preserves its powdery state. This tobacco flavoring agent may be used by being deposited on the tips of cigarettes or other tobacco products, or by being mixed with shredded tobacco leaves.

10 Claims, No Drawings

TOBACCO FLAVORING AGENT

TECHNICAL FIELD

The present invention relates to a tobacco flavoring agent that softens the unpleasant or irritating odor during smoking and provides a mild flavor by being deposited on tobacco during smoking.

BACKGROUND ART

The tar and nicotine contained in tobacco smoke determine the flavor intensity of tobacco, its irritancy, and the degree to which it is harmful. As used herein, the term "tobacco smoke" refers to both primary and secondary smoke, and the term "flavor or the like" refers both to the flavor or taste of the primary smoke inhaled directly by the smoker and to the secondary smoke inhaled by the people nearby.

In view of this, tobacco flavoring agents are commercially available for lowering the tar or nicotine content of tobacco smoke, whereby the nicotine smell or other unpleasant or irritating odors generated during smoking are softened, the flavor enjoyed by the smoker is improved, and the impact on the people nearby is reduced.

Tobacco flavoring agents comprise powders that are deposited on the tips of tobacco products during smoking and are allowed to burn together with the tobacco. Components of such agents commonly include ascorbic acid, whose reducing action lowers the nicotine or tar content and softens the flavor, and comfrey powder for reducing the nicotine smell and softening the flavor through the action of chlorophyll. Further to improve the taste, the components used sometimes include menthol to afford a sensation of freshness, and vanillin to create a sweet aroma. In addition, potassium nitrate is used as a combustion aid to improve the lighting properties of tobacco.

A drawback of conventional tobacco flavoring agents, however, is that tobacco products on which such tobacco flavoring agents have been deposited are apt to shed its burning portion during smoking. Another drawback is that a tobacco flavoring agent, which is in powder form immediately after having been manufactured, is compacted over time in the container for accommodating such agents, making it impossible for a smoker to deposit an appropriate amount of the tobacco flavoring agent on the tip of a tobacco product.

An object of the present invention, which is aimed at overcoming the shortcomings of prior art and which relates to a tobacco flavoring agent for reducing the tar or nicotine content of tobacco smoke, thereby reducing the nicotine smell and other unpleasant or irritating odors during smoking and improving the flavor, is to preserve the stable condition of an agent deposited on a tobacco product while preventing the product from shedding a burning portion of tobacco during smoking, and to preserve the stability of the powder properties while allowing an appropriate amount of the agent to be constantly deposited on the tobacco product. Another object is to provide a tobacco product in which this tobacco flavoring agent can be used in a more efficient manner.

DISCLOSURE OF THE INVENTION

The inventor perfected the tobacco flavoring agent of the present invention upon discovering that the shedding of a burning portion of tobacco during smoking can be prevented by using a prescribed maximum particle size of the potassium nitrate used as a constituent component of a tobacco flavoring agent and by using a prescribed maximum particle size of the entire constituent powder of this tobacco flavoring agent, and that an appropriate amount of the tobacco flavoring agent can always be readily deposited on the tobacco because the powder properties are kept stable. The inventor also developed a tobacco product containing the tobacco flavoring agent of the present invention upon discovering that, as a preferable embodiment of this tobacco flavoring agent, the effect of the tobacco flavoring agent can be further enhanced by mixing the tobacco flavoring agent with tobacco leaves and dispersing the components rather than depositing the flavoring agent on the tip of the tobacco product.

That is, the present invention provides a tobacco flavoring agent containing ascorbic acid, a salt or isomer thereof, a chlorophyll-containing material, and potassium nitrate, wherein this tobacco flavoring agent is characterized in that the maximum particle size of potassium nitrate is 0.8 mm or less, and preferably 0.6 mm or less.

In particular, there is provided a product in which the maximum particle size of the entire constituent powder of this tobacco flavoring agent is 0.8 mm or less, and preferably 0.6 mm or less.

Also provided is a flavored tobacco obtained by admixing the tobacco flavoring agent of the present invention into shredded tobacco leaves.

BEST MODE FOR CARRYING OUT THE INVENTION

The present invention will now be described in detail.

The tobacco flavoring agent of the present invention contains ascorbic acid, a salt or isomer thereof, a chlorophyll-containing material, and potassium nitrate.

Here, the ascorbic acid and the salts or isomers thereof are used to reduce the content of tar, nicotine, and carbon monoxide in tobacco smoke in the same manner as in the case of conventional tobacco flavoring agents, thereby softening the nicotine smell and other unpleasant or irritating odors during smoking. Examples of ascorbic acid and salts or isomers thereof include D- and L-ascorbic acids, sodium salts thereof, and other salts, of which L-ascorbic acid (Vitamin C) is preferable for use.

The chlorophyll-containing materials are used in order to soften the unpleasant odor of tobacco, and particularly to eliminate the nicotine smell and to soften the flavor, by the action of the chlorophyll. Various chlorophyll-containing powders or liquids can be used as such chlorophyll-containing materials. It is possible to use comfrey, chlorella, chlorophyll, and the like in the form of powders, pastes, or liquids. Of these, comfrey powder is preferred because it improves the adhesion of the tobacco flavoring agent to the tobacco in addition to providing excellent deodorization. In addition, chlorella powder is preferred from the standpoint of color coordination and stability.

Potassium nitrate is used as a combustion aid for tobacco. A characteristic feature of the present invention is that a powder having a maximum particle size of 0.8 mm or less is used as this potassium nitrate. In conventional tobacco flavoring agents, no consideration is given to the effect of the particle size of potassium nitrate, and the powder whose particle size varies considerably and is much greater than 0.8 mm has been used as such potassium nitrate. When potassium nitrate having such a particle size is used, a burning portion of tobacco is readily shed during smoking from tobacco products on which the tobacco flavoring agents have been deposited. In addition, an initially powdered tobacco flavoring agent is compacted over time in a storage container, making it difficult for a smoker to deposit an appropriate amount of the tobacco flavoring agent on the tip of a tobacco product. By contrast, using potassium nitrate whose maximum particle size is 0.8 mm or less (as in the present invention) makes it possible to stably maintain the burning portion of tobacco and to prevent the initially powdered tobacco flavoring agent from becoming compacted over time.

The optimum particle size of potassium nitrate depends on the content of potassium nitrate in the tobacco flavoring agent and on other parameters. Under common conditions, however, it is more preferable for the maximum particle size to be kept at or below 0.6 mm. It is also preferable for the particle size distribution to be 40% "through" and 60% "on" in the case of a 100-mesh sieve.

Thoroughly grinding down commercially available potassium nitrate in an agate mortar can be cited as an example of a method for adjusting the maximum particle size of potassium nitrate to 0.8 mm or less.

Various components may be admixed as needed into the tobacco flavoring agent of the present invention. For example, menthol, vanillin, and the like can be admixed in order to afford a sensation of freshness or a sweet aroma to the flavor. Stevia or the like can be admixed in order to impart sweetness. Herbs or citrus (such as lemon) may also be admixed in order to induce changes in the flavor. Fatty acids (stearic acid, oleic acid, and the like), boric acid, and the like can be admixed in order to fix volatile nicotine and to facilitate tar decomposition at high temperatures. Malic acid, citric acid, or the like can be admixed in order to facilitate the formation of nicotine organic acid salts, to reduce the amount of volatile free nicotine, to promote the conversion of nicotine to nicotinic acid during burning, and to soften the irritating odor during smoking. Lecithin or the like can be admixed in order to improve powder properties. It is also possible to admix lactose, maltose, vegetable oils and fats, Chinese matrimony vine, glycyrrhizin, *Sasa albo-marginata*, licorice, *Ganoderma lucidum Karst*, arrowroot leaves, and various other components.

The ratios in which the components are admixed into the tobacco flavoring agent can be appropriately set depending on the type, properties, and other parameters of the components being admixed. Under ordinary conditions, the ascorbic acid or salts or isomers thereof should be used preferably in an amount of 5–15 wt %, and more preferably 8–10 wt %. When in the form of powders, the chlorophyll-containing materials should be used preferably in an amount of 10–20 wt %, and more preferably 14–18 wt %. In addition, potassium nitrate should be used preferably in an amount of 3–8 wt %.

The tobacco flavoring agent of the present invention can be obtained as a powder by thoroughly mixing the components. In this case, the maximum particle size of the entire constituent powder should be set preferably to 0.8 mm or less, and more preferably 0.6 mm or less. This approach makes it possible to better prevent a tobacco flavoring agent prepared in the form of a powder from becoming compacted over time in a container for accommodating such agents.

A powder which remains on a 40-mesh screen but passes through a 24-mesh screen (microsifter screen manufactured by Dalton) should be used in the method for adjusting the particle size of the entire tobacco flavoring agent in such a manner.

The tobacco flavoring agent of the present invention is not subject to any particular limitations in terms of the manner in which this agent is used. Examples include cigarettes, shredded tobacco, and other tobacco products.

In the specific example of a cigarette with one unit weight of about 1 g, the tobacco flavoring agent is deposited in an amount of 1–50 mg, and preferably 1–10 mg, on the lighting tip of the cigarette and burned together with the cigarette, or the tobacco flavoring agent is admixed in an amount of 0.01–5 wt % into shredded tobacco leaves, a flavored tobacco product in which the agent is dispersed throughout the entire product is prepared, and the product is used as shredded tobacco for cigarettes, pipes, traditional Japanese pipes, hand-rolled cigarettes, and the like.

The latter method is preferable for the use of tobacco flavoring agents because of their more efficient utilization, and particularly because of the higher efficiency with which the nicotine content of tobacco smoke is reduced. Consequently, the present invention includes flavored tobacco obtained by admixing the tobacco flavoring agent of the present invention into shredded tobacco leaves. Of flavored tobacco products, those in the form of cigarettes are preferred because the end user can easily inhale tobacco smoke by performing operations identical to those performed when handling conventional cigarettes devoid of tobacco flavoring agents.

EXAMPLES

The present invention will now be described in detail on the basis of its examples.

Working Example 1, Comparative Example 1, and Comparative Example 2

Components were mixed in the mixing ratios shown in Table 1, and the particle size was adjusted with a sieve, yielding powdered tobacco flavoring agents.

Evaluation (1) Stability Test of Burning Tobacco

The tobacco flavoring agents of Working Example 1 and Comparative Example 1 were each deposited in an amount of 6 mg on the tip of a tobacco product ("Peace"), the tobacco product was lighted and smoked, and the stability with which the tobacco burned during smoking was evaluated.

As a result, no burning portion of tobacco at all was shed from the section extending over a distance of 4 cm from the tip of a tobacco product on which the tobacco flavoring agent of Working Example 1 had been deposited, whereas a burning portion of tobacco started to fall out during the second puff in the case of a tobacco product on which the tobacco flavoring agent of Comparative Example 1 had been deposited.

(2) Stability Test of Powdered State

A container with an inside diameter of 1 cm and a height of 6 cm was filled with the tobacco flavoring agent of Working Example 1 or Comparative Example 1 and left in a room without being closed with a lid. A tobacco product ("Peace") was inserted into the container after a prescribed time had elapsed, and an evaluation was conducted as to whether a prescribed amount (about 6 mg) of the tobacco flavoring agent had deposited on the tip of the tobacco product.

The results indicated that whereas the tobacco flavoring agent of Working Example 1 had deposited in an adequate amount on the tobacco product even after being stored for 1 year, the tobacco flavoring agent of Comparative Example 1 was difficult to deposit on the tobacco product after being stored for 1 day (in rainy weather), and had compacted inside the container and could not be deposited on the tobacco product after being stored for 1 year.

(3) Organoleptic Test of Flavor

The tobacco flavoring agents of Working Example 1 and Comparative Example 1 were each deposited in an amount of 6 mg on the tip of a tobacco product ("Peace"), the tobacco product was lighted, and the flavor was organoleptically evaluated. In addition, a tobacco product on which no tobacco flavoring agent had been deposited was lighted as Comparative Example 2 (blank), and the flavor thereof was organoleptically evaluated. The evaluation results are shown in Table 1.

(4) Measurement of Nicotinic Acid in Primary Smoke

Tobacco products were suctioned at a suctioning rate of about 3 minutes per cigarette from the side opposite the lighted side, and the nicotinic acid in the suctioned gas (primary smoke) was absorbed by a nicotinic acid absorbent solution (1 N sodium hydroxide) in cases in which the tobacco flavoring agents of Working Example 1 and Comparative Example 1 were each deposited in an amount of 6 mg on the tips of tobacco products ("Peace"), and the tobacco products were lighted, and in a case in which a tobacco product on which no tobacco flavoring agent had been deposited was lighted as Comparative Example 2 (blank). Such nicotinic acid absorption was performed for 20 tobacco products, and the nicotinic acid content of the nicotinic acid absorption solution was determined by the bioassay method according to the guidelines for food and sanitation inspection under the supervision of the Environmental Health Bureau of the Welfare Ministry.

The results are shown in Table 1. These results indicate that in comparison with the case (Comparative Example 2) in which smoking was performed without the use of a tobacco flavoring agent, the use of the tobacco flavoring agent of Working Example 1 had increased the content of nicotinic acid in primary smoke by a factor of about 1.6, and the biologically hazardous nicotine contained in the primary smoke had been efficiently converted to nicotinic acid. In addition, a comparison between the results of Working Example 1 and the results of Comparative Example 1 indicates that the efficiency with which the tobacco flavoring agents converted nicotine to nicotinic acid did not change when the particle size of the components constituting the tobacco flavoring agents was 0.6 mm or less.

(5) Measurement of Tar in Primary Smoke

Inhaled gas (primary smoke) was suctioned via a glass-fiber filter from the side opposite the lighted side and absorbed by an absorbent solution in cases in which the tobacco flavoring agents of Working Example 1 and Comparative Example 1 were each deposited in an amount of 6 mg on the tips of tobacco products ("Peace"), and the tobacco products were lighted, and in a case in which a tobacco product on which no tobacco flavoring agent had been deposited was lighted as Comparative Example 2 (blank). The glass-fiber filters were washed with the absorbent solution when a section of tobacco extending over a distance of 1 cm from the tip had been consumed, and when a section of tobacco extending over a distance of 1 to 4 cm from the tip had been consumed. The glass-fiber filters were dried, and the increase in the weight of these glass-fiber filters was termed the tar content.

The results are shown in Table 1. This table shows three tar contents; (i) the tar content resulting from the consumption of the section extending 1 cm from the tip, (ii) the tar content resulting from the consumption of the section extending 1 to 4 cm from the tip, (iii) and the combined tar content ((i)+(ii)).

The results indicate that using the tobacco flavoring agent of Working Example 1 reduced the tar content of primary smoke by about 20% in comparison with smoking in which no tobacco flavoring agents were used (Comparative Example 2). In addition, a comparison between the results of Working Example 1 and the results of Comparative Example 1 indicates that the efficiency with which the tobacco flavoring agents reduced the tar content of primary smoke did not change when the particle size of the components constituting the tobacco flavoring agents was 0.6 mm or less.

TABLE 1

(Unit: weight part)

| | Working Example 1 | Comparative Example 1 | Comparative Example 2 |
|---|---|---|---|
| Ascorbic acid | 0.5 | 0.5 | |
| Comfrey powder*1 | 1.6 | 1.6 | |
| Menthol | 0.3 | 0.3 | |
| Vanillin*2 | 0.8 | 0.8 | |
| Boric acid | 0.6 | 0.6 | |
| Stearic acid | 1.4 | 1.4 | |
| Malic acid | 0.5 | 0.5 | |
| Citric acid | 1.0 | 1.0 | |
| Lactose | 1.2 | 1.2 | |
| Stevia*3 | 0.5 | 0.5 | |
| Lecithin*4 | 3.2 | 3.2 | |
| Potassium nitrate (maximum particle size) | 0.4 (>0.6 mm) | 0.4 (<0.8 mm) | |
| Maximum particle size of tobacco flavoring agent | >0.6 mm | <0.8 mm | |
| Evaluation | | | |
| (1) Stability of burning tobacco | Stable | Unstable | |
| (2) Stability of powdered state | Stable | Prone to compaction | |
| (3) Flavor | Mild sweet flavor with suppressed nicotine smell or irritating odor | Mild sweet flavor with suppressed nicotine smell or irritating odor | Strong nicotine smell or irritating odor |
| (4) Nicotinic acid content (μg/20 cig) | 755 | 755 | 475 |
| (5) Tar content (mg/cig) 1 cm, 1–4 cm, total | 0.3, <0.1, 0.3 | 0.3, <0.1, 0.3 | 0.8, 0.6, 1.4 |

Notes to Table 1
*1Comfrey powder, manufactured by Takasago Yakuhin KK
*2Vanillin, manufactured by Matsumoto Koryo KK
*3Stevia, manufactured by Dainippon Ink Co., Ltd.
*4Lecithin, manufactured by Maruki Honpo KK

Working Example 2

A tobacco flavoring agent was prepared in the same manner as in Working Example 1 except that the comfrey powder (manufactured by Takasago Yakuhin KK) used in the amount of 1.6 weight parts during the preparation of the tobacco flavoring agents of Working Example 1 was replaced with 1.3 weight parts of a chlorella powder (manufactured by Nihon Chlorella KK), yielding the tobacco flavoring agent of Working Example 2.

The tobacco flavoring agent of Working Example 2 was used in the same manner as in Working Example 1 to evaluate the stability of burning tobacco, the stability of the powdery state, the flavor, the nicotinic acid content of primary smoke, and the tar content of primary smoke. According to the results, the tobacco flavoring agent of Working Example 2 showed the stabilization of burning tobacco or powdery state in the same manner as the tobacco flavoring agent of Working Example 1. In addition, the flavor was a mild, sweet flavor in which the nicotine smell or irritating odor was suppressed in the same manner as in Working Example 1; the tar content was much lower than when smoking was performed without the use of a tobacco flavoring agent (Comparative Example 2); and the content of nicotinic acid was higher.

INDUSTRIAL APPLICABILITY

The tobacco flavoring agent of the present invention lowers the content of tar or nicotine in tobacco smoke, making it possible to soften the nicotine smell and other unpleasant or irritating odors during smoking and to maintain stability without allowing a burning portion of tobacco to be shed from a tobacco product during smoking. In addition, an appropriate amount of the tobacco flavoring agent can be stably deposited on a tobacco product because the powder properties of the flavoring agent itself are preserved.

Furthermore, the flavored tobacco of the present invention makes it easier to smoke a tobacco in which the tobacco flavoring agent of the present invention is utilized with higher efficiency.

What is claimed is:

1. A tobacco flavoring agent, comprising:

ascorbic acid a salt of ascorbic acid or an isomer of ascorbic acid:

a chlorophyll-containing material; and potassium nitrate, wherein the maximum particle size of the potassium nitrate is 0.8 mm or less.

2. The tobacco flavoring agent according to claim 1, wherein the maximum particle size of the potassium nitrate is 0.6 mm or less.

3. The tobacco flavoring agent according to claim 1, wherein the agent further comprises stearic acid or boric acid.

4. The tobacco flavoring agent according to claim 1, wherein the agent further comprises citric acid or malic acid.

5. The tobacco flavoring agent according to claim 1, wherein the agent further comprises menthol or vanillin.

6. The tobacco flavoring agent according to claim 1, wherein the agent further comprises the following components (a), (b), and (c):

(a) Stearic acid or boric acid (b) Citric acid or malic acid (c) Menthol or vanillin.

7. The tobacco flavoring agent according to claim 1–6, wherein the maximum particle size of the entire constituent powder of the tobacco flavoring agent is 0.8 mm or less.

8. The tobacco flavoring agent according to claim 7, wherein the maximum particle size of the entire constituent powder of the tobacco flavoring agent is 0.6 mm or less.

9. A flavored tobacco, obtained by admixing a tobacco flavoring agent according to claim 1 into shredded tobacco leaves.

10. A cigarette, comprising the flavored tobacco according to claim 9.

* * * * *